United States Patent [19]

Beisel et al.

[11] 4,351,236

[45] Sep. 28, 1982

[54] COMBINED DAMPENING-INKING UNIT FOR OFFSET PRINTING MACHINES

[75] Inventors: Hermann Beisel, Walldorf; Hermann Kraft, Dossenheim, both of Fed. Rep. of Germany

[73] Assignee: Heidelberger Druckmaschinen Aktiengesellschaft, Heilderberg, Fed. Rep. of Germany

[21] Appl. No.: 86,139

[22] Filed: Oct. 18, 1979

[30] Foreign Application Priority Data

Oct. 21, 1978 [DE] Fed. Rep. of Germany ..... 2845932

[51] Int. Cl.[3] ..... B41F 7/40; B41F 31/34; B41L 25/14

[52] U.S. Cl. ..... 101/148; 101/352

[58] Field of Search ..... 101/148, 349, 350, 351, 101/352, 206, 207, 208, 209

[56] References Cited

U.S. PATENT DOCUMENTS

| | | | |
|---|---|---|---|
| 3,146,706 | 9/1964 | Tonkin et al. | 101/148 |
| 3,673,959 | 7/1972 | Jezuit et al. | 101/148 |
| 3,769,909 | 11/1973 | Fugman et al. | 101/148 |
| 3,805,700 | 4/1974 | Chamson | 101/148 |
| 3,842,735 | 10/1974 | Southam et al. | 101/145 |
| 3,911,815 | 10/1975 | Banfer | 101/148 |
| 3,926,116 | 12/1975 | Wildeman | 101/148 |

FOREIGN PATENT DOCUMENTS

| | | |
|---|---|---|
| 1536450 | 1/1970 | Fed. Rep. of Germany . |
| 1923475 | 1/1970 | Fed. Rep. of Germany . |
| 1611263 | 4/1973 | Fed. Rep. of Germany . |
| 2364171 | 6/1974 | Fed. Rep. of Germany . |
| 2343935 | 3/1975 | Fed. Rep. of Germany . |
| 2211348 | 7/1974 | France . |

*Primary Examiner*—J. Reed Fisher

*Attorney, Agent, or Firm*—Herbert L. Lerner; Laurence A. Greenberg

[57] ABSTRACT

Combined dampening-inking unit for offset printing units having inking rollers engageable with a plate cylinder and including, as viewed in rotational direction of the plate cylinder, a first inking roller mounted so as to be adjustable independently of at least another next succeeding inking roller disposed in the rotational direction of the plate cylinder, and a dampening-medium distributor roller of a dampening unit cooperatively engageable with the first inking roller, including an oleophilic intermediate roller connecting the first and the next succeeding inking rollers to one another, an ink distributor roller engaging the next succeeding inking roller, the first inking roller being mounted so as to be swivelable about the dampening-medium distributor roller and liftable therefrom, and control means for selectively engaging the first inking roller with the plate cylinder, the intermediate roller and the dampening-medium distributor roller and for selectively disengaging the first inking roller therefrom.

4 Claims, 9 Drawing Figures

COMBINED DAMPENING-INKING UNIT FOR OFFSET PRINTING MACHINES

The invention relates to a combined dampening-inking unit for offset printing machines having inking rollers engageable with a plate cylinder and including, as viewed in direction of rotation of the plate cylinder, a first inking roller connected by an oleophilic intermediate roller to a next succeeding inking roller, the latter as well as any subsequent inking rollers, being each in contact with an ink distributor roller, and also including a damping solution or dampening medium distributor roller of a damping unit which cooperates with the first inking roller.

U.S. Pat. No. 3,926,116 describes a dampening unit and an inking unit which are linked to one another during printing by means of an intermediate roller. This intermediate roller has an oleophilic outer cylindrical surface and is in contact during the production run with a sole dampening medium applicator roller as well as with the first inking roller. Its task is to remove ink particles from the outer cylindrical surface of the dampening medium applicator roller and to return them to the inking unit. Its outer cylindrical surface is apparently of such construction that it accepts no dampening medium whatsoever.

As is generally known, the ink film of an inking unit in offset printing presses absorbs a certain quantity of dampening medium or solution from the plate. The absorption of dampening medium depends upon the nature of the ink and lasts until an equilibrium between ink and dampening medium has been reached in the inking unit. During the lengthy period of dampening medium absorption there is a constant change in inking behavior i.e. in the supply of ink to the plate.

The hereinaforementioned previously known device may perhaps prevent excessive inking of the dampening unit rollers with the aid of the intermediate roller, but the length of the critical inking unit predamping period cannot be reduced by means of this intermediate roller, because the latter is not brought into engagement with the dampening medium applicator roller until the beginning of the production run. When the offset printing machine is started up after brief or lengthy stoppages or interruptions, this necessarily therefore leads to the production of waste due to the constant change in inking behavior.

It is accordingly an object of the invention to provide a combined dampening-inking unit with which one quickly can obtain the inking-dampening equilibrium before the start of printing as well as guarantee a constant, complete operational readiness of the offset printing machine during stoppages or interruptions so that there is a minimum of waste. In addition, an improved and more stable inking dampening equilibrium is sought to be achieved during the production run.

With the foregoing and other objects in view, there is provided, in accordance with the invention, a combined dampening-inking unit wherein the first inking roller is shiftable into three control positions and is driven by friction whereby the first inking roller, in the three control positions, engages the plate cylinder and/or the dampening medium distributor rollers and/or the intermediate roller.

According to the invention, when in the production run position, the first inking roller is in contact with the plate cylinder, distributor roller and intermediate roller.

For the purpose of predampening as well as for washing the printing unit, it is possible to bring the first inking roller simultaneously into engagement with the dampening medium distributor roller and the intermediate roller. If the plate is to be predampening, the first inking roller is in contact with the dampening medium distributor roller and with the plate cylinder. If, finally, during lengthy interruptions or stoppages, there is a desire to keep the inking unit and dampening unit sections separate from the point of view of operational readiness, then it is possible, with the inking rollers disengaged, additionally to interrupt contact between the first inking roller and the dampening medium distributor roller, contact being made with the inking unit by means of the intermediate roller.

Due to these numerous control variations with regard to the position of the first inking roller, it is possible, in conjunction with the intermediate roller, to create optimal conditions for starting-up and for the production run. The oleophilic intermediate roller, for example, a steel roller covered with plastic material, also ensures that the first inking roller will not only transfer dampening medium but also a little ink to the plate. As viewed in direction of rotation of the plate cylinder, the proportion of ink transferred by each of the succeeding inking rollers increases whereas the proportion of dampening medium decreases. The constant balancing of dampening medium and ink by means of the intermediate roller as well as the application of ink and dampening medium in the gradated or blended manner described hereinbefore cause the ink to make better contact with the paper i.e. the print becomes more brilliant. Furthermore, the constant flow of dampening medium or solution and ink by means of the intermediate roller makes the dampening process insensitive to the influence of the plate cylinder gap as well as to the division between printing and non-printing locations on the plate cylinder for any given printing job. Thus, for example, in separate inking and dampening units there is an insufficient renewal of the ink-water emulsion when there are only a few square centimeters of printing area on a plate surface of 1 $m^2$. This favors a so-called ink build-up on the first rollers.

In a further embodiment of the combined dampening-inking unit for offset printing presses according to the invention having inking rollers which are engageable with the plate cylinder and including, as viewed in direction of rotation of the plate cylinder, a first inking roller is connected by an intermediate roller to a next succeeding inking roller, the latter as well as any subsequent inking rollers being each in contact with an ink distributor roller, and also including a dampening medium distributor roller cooperating with the first inking roller, as well as a metering roller cooperating with a dipping or fountain roller and which supplies the dampening medium to the dampening medium distributor roller, the dipping roller being stationary, the metering roller being adjustable with respect to the spacing thereof from the dipping roller, a special drive being provided for driving the dipping roller at variable speed, the metering roller being driven by the dipping roller drive, and the metering roller rotating in opposite rotary direction to the dampening medium distributor roller in the contact zone therebetween.

The fact that the metering roller rotates in opposite rotary direction to the dampening medium distributor roller, a more-or-less horizontal arrangement of the row of damping rollers is permitted whereby the outer cylindrical surface of the metering roller, which is important with respect to dampening, may be inspected from above. The alignment of the rollers is considerably facilitated by the ability to make a visual inspection of the film of dampening medium on the metering roller after the nip or meterming or squeezing gap between the dipping roller and the metering roller. Of decisive importance, furthermore, is the fact that the directions of rotation of the dipping roller and the metering roller permit dampening medium to flow back from the first roller gap into the dampening medium tank or fountain. Finally, the hereinaforementioned horizontal arrangement of the the row of dampening rollers provides good accessibility for any further dampening rollers which have to be mounted below the dampening medium distributor roller.

U.S. Pat. No. 3,433,155 describes a combined dampening-inking unit having a dampening medium distributor roller which is fed by a dipping roller via a metering roller cooperating with the first inking roller. Since the dampening medium distributor roller and the metering roller have the same direction of rotation in the contact zone therebetween, the flowing back of dampening medium from the nip or gap betwen the dipping roller and the metering roller makes it necessary for these two rollers to be positioned one above the other. This precludes the possiblity of a visual inspection of the outer cylindrical surface of the measuring roller which is important with regard to dampening.

In accordance with yet another advantageous embodiment of the invention, the frictionally engaged metering and dipping rollers have such a transmission ratio, relative to the transmission ratio of the toothed gear drive of the metering roller which is derived from the journal of the fountain roller, that the circumferential or peripheral speed of the metering roller is slightly greater than that of the dipping roller.

This ensures constant contact of the driving flanks of the toothed gear drive of the metering roller. Slip occurring between the dipping roller and the metering roller advantageously cleans the outer cylindrical surface of the dipping roller.

In accordance with an added feature of the invention, the intermediate roller which cooperates both with the first as well as with the second inking roller is mounted so that it can traverse. This traversing prevents ink build-up on the first inking roller as well as any "stenciling" effect caused by the inking rollers.

All of the hereinabove-described embodiments of the invention are operable using a method of quickly achieving inking-damping equilibrium as well as of ensuring balanced inking and dampening of an offset printing plate during the production run.

There is thus provided, in accordance with the invention, a method of rapidly attaining ink-dampening medium equilibrium and of ensuring balanced inking and dampening of an offset plate during a production run with a combined dampening-inking unit for offset printing units, which comprises (a) predampening the dampening unit section of the combined dampening-inking unit during shutdown of the printing machine by driving the dipping and the metering rollers, (b) while the inking rollers are disengaged from the plate, with the printing machine in operation, predampening the entire inking-dampening unit by bringing the first inking roller, which is in engagement with the intermediate roller, into engagement with the dampening-medium distributor roller, (c) disengaging the first inking roller from the intermediate roller and engaging the first inking roller with the plate cylinder while maintaining contact with the dampening-medium distributor roller so as to predampen the plate and supply it with a given portion of fresh ink, (d) superdamping the plate during an adjustable time interval with increased rotational speed of the dipping roller, and with the rollers in the same positions as for a predampening stage as in (e) hereinafter, and (e) bringing the next succeeding ink roller into engagement with the plate cylinder for a production run, and bringing the first inking roller, already engaging the plate cylinder, into contact again with the intermediate roller. An offset printing press started and operated using this method produces virtually no waste.

The method featured in the invention can be advantageously modified in that, during a short stoppage or interruption, the first inking roller remains in engagement with the plate while the other inking rollers are disengaged and the intermediate roller lifted off the first inking roller whereby, by switching the press to "production run", the process begins at the stage of "superdampening the plate".

Another preferred embodiment of the method according to the invention provides, during a lengthy stoppage or interruption, for the first inking roller to be disengaged both from the plate as well as from the dampening solution distributor roller and for it to be brought into engagement with the intermediate roller whereby, after switching the press to "production run", the process begins at the stage of "predampening the inking unit".

The combined dampening-inking unit featured in the invention also permits the washing to the rollers including even the metering roller without wetting the plate. The dipped roller is excluded from the washing process. The individual steps of the washing method featured in the invention include lifting the metering roller off the dipping roller during the washing of the combined dampening-inking unit, whereby the metering roller driving gear is separated from the fountain roller drive, and the position of the other rollers corresponds to that during "predampening the inking unit". The washing process can only be started when the metering roller driving gear is separated from the dipping roller drive. Tests have revealed that the quantity of dampening medium flowing back towards the dampening medium tank over the chromium-plated medium distrubutor roller contains ink particles. These are usually deposited on the metering roller which has an oleophilic outer cylindrical surface. Regular washing to the metering roller therefore prevents the damping medium in the dampening medium tank being enriched with ink. This improves the oerational readiness of the press.

Other features which are considered as characteristic for the invention are set forth in the appended claims.

Although the invention is illustrated and described herein as embodied in combined dampening-inking unit for offset printing units, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
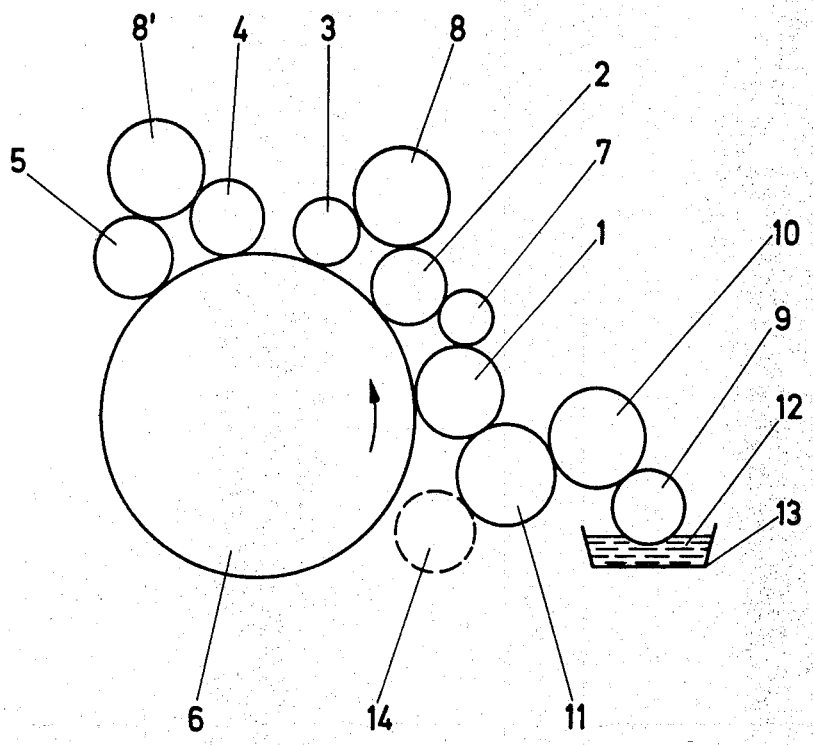
FIG. 1 is a diagrammatic view of the rollers of a combined dampening-inking unit according to the invention located in vicinity of the plate cylinder.

Referring now to FIGS. 1 to 9 of the drawing, there is shown therein a combined dampening-inking unit having five inking rollers 1 to 5 mounted so as to be engageable with and disengageable from a plate cylinder 6 of a rotary offset printing machine. The first inking roller 1 viewed in rotary direction of the plate cylinder 6 is connected to the next succeeding inking roller 2 by an intermediate roller 7. The inking rollers 2 and 3 are in contact with an ink distributor roller 8, and the last two inking rollers 4 and 5 with an ink distributor roller 8'. Besides, the inking unit train is provided with additional non-illustrated rollers of conventional type.

Dampening medium is supplied to the first inking roller 1 with the aid of a dipping or fountain roller 9 by means of a metering roller 10 and a dampening medium distributor roller 11 cooperating with the inking roller 1. The dipping roller 9 is immersed in the damping medium 12 in a dampening medium tank or fountain 13. An accumulator roller 14, shown in a broken line, and provided, however, only for certain specific types of printing work, may also cooperate with the dampening medium distributor roller 11.

The five inking rollers 1 to 5 have an oleophilic or ink receptive, elastic surface. The outer cylindrical surface of the intermediate roller 7 is likewise of oleophilic construction. It may be formed for example of the material known by the trade name Rilsan. The outer cylindrical surfaces of the two ink distributor rollers 8 and 8' are constructed in a similar manner. The dampening-medium distributor roller 11 has an electrolytically roughened chromium surface whereas the metering roller 10 has a rubber outer cylindrical surface. The outer cylindrical surface of the fountain roller 9 is also formed of an electrolytically roughened chromium layer. Depending upon whether the accumulator roller 14 is used in an alcohol-type or normal dampening unit, it is provided either with a rubber blanket or outer cylindrical surface or with a textile covering.

Bearing and adjusting means for all the rollers, insofar as they are not expressly described herein, correspond to the constructions generally known in printing technology. The three distributor rollers 7,8 and 11 are positively (form-lockingly) driven whereas the five inking rollers 1 to 5 and the intermediate roller 7 are driven only by means of friction. The intermediate roller 7 which has a considerably smaller diameter than that of the neighboring inking rollers 1 and 2 is mounted so as to be traversible. The traversing, aided by the greater rotary speed of the intermediate roller 3 as compared with the rotary speed of the neighboring inking rollers 1 and 2, counteracts so-called "stenciling".

Figure 2:
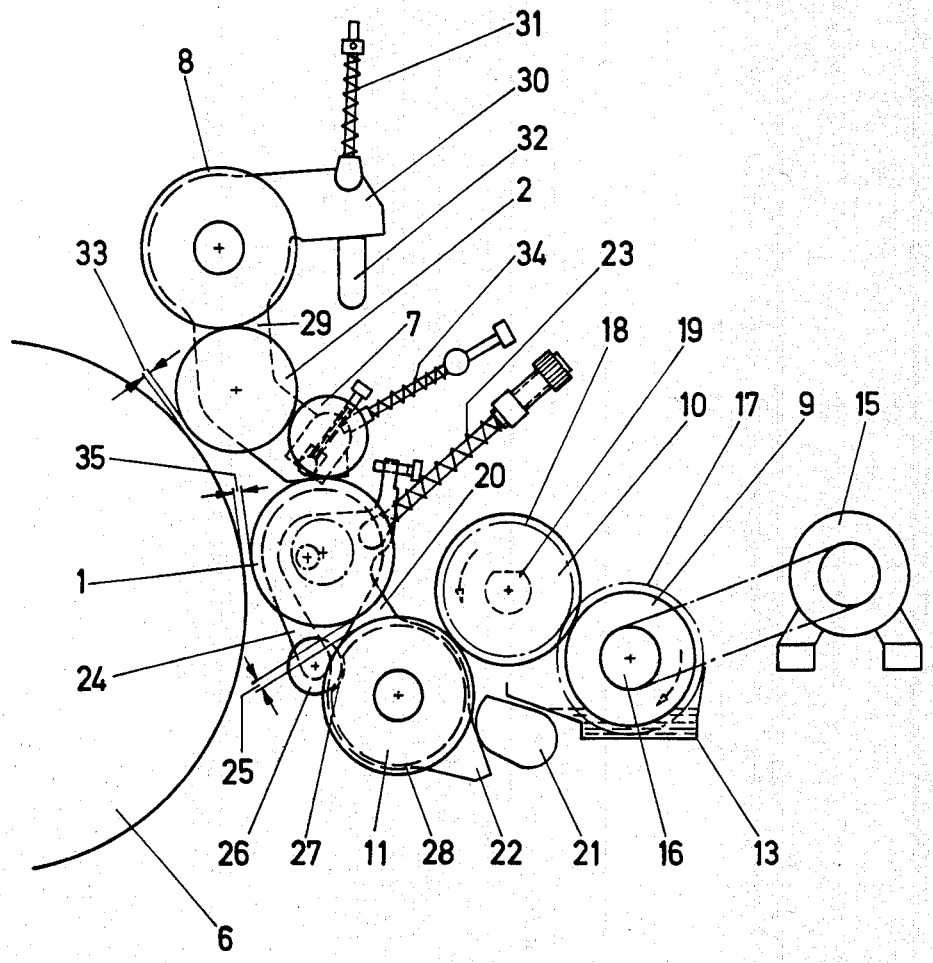
FIG. 2 is an enlarged view of FIG. 1 showing the dampening-inking unit in greater detail and in a setting "Predampening Dampening Unit"

As shown in FIG. 2, the dipping or fountain roller 9 is directly drivable by a separate motor 15 at a peripheral speed variable in relationship to the peripheral speed of the plate cylinder 6. A spur gear 17 is provided on one of the two shaft journals 16 of the dipping roller 9 and meshes with another spur gear 18 which is located on one of the shaft journals 19 of the metering roller 10. The metering roller 10 is thus driven at virtually the same peripheral speed as the dipping or fountain roller 9. The transmission ratio of the frictionally engaging dripping and metering rollers 9 and 10 relative to the transmission ratio of the gear drive 17,18 of the metering roller 10 deriving from the shaft journal 16 of the dipping roller 9 is so selected, however, that the peripheral speed of the metering roller 10 is slightly greater than that of the dipping roller 9. Assurance is thereby provided that the driving flanks of the spur gear 17 will always engage the tooth flanks of the driven spur gear 18 on the shaft journal 19 of the metering roller 10.

The dipping roller 9 is mounted in stationary bearings. The metering roller 10, on the other hand, is disposed so as to be adjustable in spacing from the dipping roller 9. Moreover, by shifting the metering roller 10, the gap or the applied pressure in the engagement and contact zone, respectively, between the dampening-medium distributor roller 11 and the metering roller 10 are adjusted. The inking roller 1 is swivelable about the rotational axis of the dampening-medium distributor roller 11 by bearing brackets or support arms 20. The swiveling is effected by a trip cam 21 which is actuated by a non-illustrated step switch and cooperates with a trigger beak or projection 22 formed on the bearing brackets 20. Adjustable compression springs 23 exert such a force upon the bearing brackets 20 that the trigger beak 22 is always forced in a direction toward the trip cam 21.

The inking roller 1 is eccentrically mounted in the bearing brackets 20 in a way that, by swivelling a roller lever 24, the outer cylindrical surface of the inking roller 1 is separated from the outer cylindrical surface of the dampening-medium distributor roller 11 by a gap 25. An idler roller 26 located on the roller lever 24 lifts the inking roller 1 away from the damping-medium distributor roller 11 and, in the phase setting or position of FIG. 2, has fallen into a recess 27 formed in a control cam 28. The control cam 28 is mounted coaxially with the dampening-medium distributor roller 11 and is swivelable with the bearing brackets 20.

The intermediate roller 7 and the inking roller 2 are rotatably and adjustably mounted on common bearing brackets 29. They are swivelable about the rotational axis of the ink distributor roller 8. An adjusting beak or projection 30 rigidly connected to the bearing brackets 29 is forced against a trip cam 32 by a compression spring 31. By means of this trip cam 32, the inking roller 2 can be lifted off the plate cylinder 6 a given distance so as to define a gap 33 therebetween. At the same time the intermediate roller 7 is also swiveled therewith through the same angle. Moreover, the intermediate roller 7 is independently spring-mounted in the bearing brackets 29 by means of compression springs 34, so that it can adjust to the individual positions of the two neighboring inking rollers 1 and 2. In the phase position or setting shown in FIG. 2, the inking roller 1 is, moreover, lifted away from the outer cylindrical surface of the plate cylinder 6 a distance corresponding to the width of a gap 35 due to actuation of the trip cam 21.

Upon start-up of the offset printing machine, the setting or positions of the rollers as shown in FIG. 2, correspond to the first control stage. The main switch is switched on. The power supply to all operating points is ensured. The dampening medium circulation has started operating.

After pressing a pushbutton "Operation", the motor 15 drives the fountain or dipping roller 9 and the metering roller 10 at an increased speed of, for example, 200 rpm. The main motor is not yet switched on, for which reason, the plate cylinder 6 and all of the other rollers of the combined dampening-inking unit according to the invention continue to remain at rest. During this start-up phase, wherein the so-called start-up warning signal is normally given, the dampening unit section formed of the dipping roller 9 and the metering roller 10 is predampening. After this selective time interval of, for example, three seconds, the rotary speed of the dipping roller 9 is regulated down to 10 rpm. The damping unit section is ready for operation.

Figure 3:
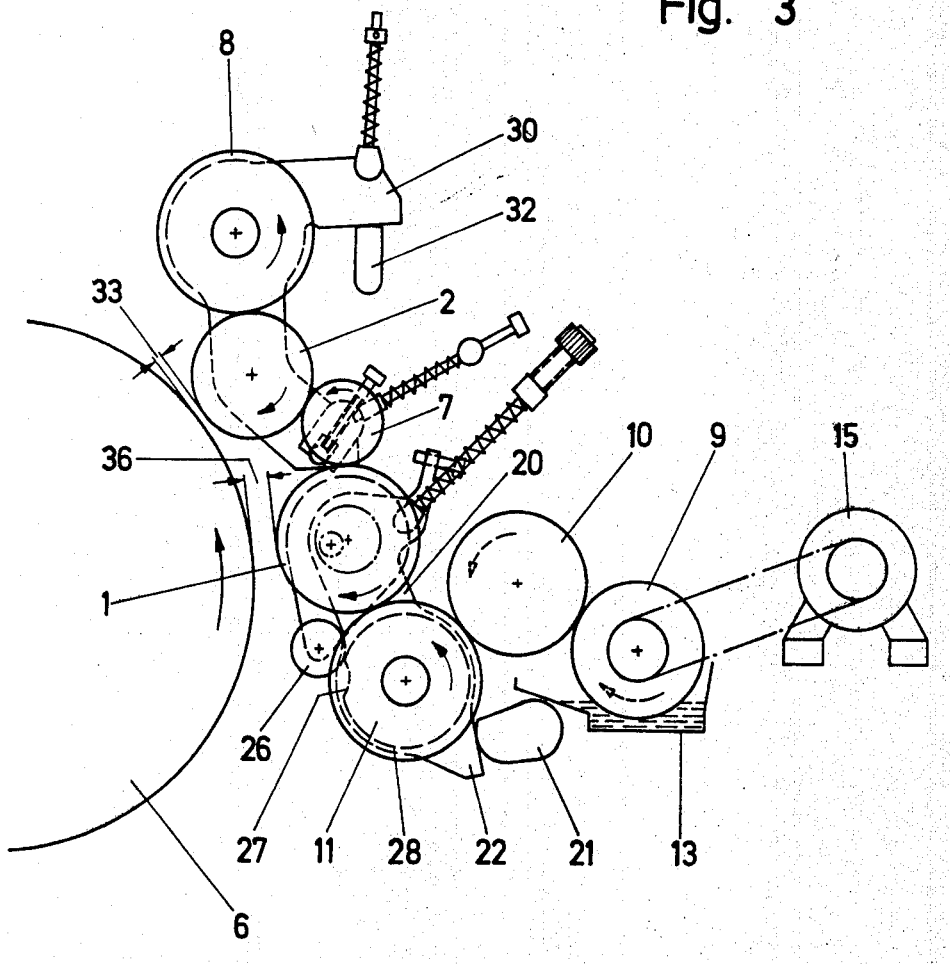
FIG. 3 is another view of FIG. 2 showing the dampening-inking unit in a setting "Predampening Inking Unit"

Following the start-up warning signal, the main motor is automatically set into operation. The plate cylinder 6 and the illustrated rollers 11, 1, 7, 2 and 8, as well as the other non-illustrated rollers of the combined dampening-inking unit, begin to rotate. The direction of rotation of the distributor roller 11, however, is opposite that of the metering roller 10, in the contact or engagement zone. A non-illustrated stage control has swiveled the bearing brackets 20 somewhat farther in clockwise direction through the trip cam 21 and the control beak or projection 22. The idler roller 26 has come out of the recess 27 of the control cam 28 and has brought the inking roller 1 into engagement with the dampening-medium distributor roller 11. Simultaneously, due to the swiveling of the bearing brackets 20 as shown in FIG. 3, the inking roller 1 has come into engagement with the intermediate roller 7.

In this control setting of all of the rollers, the inking unit is predampening. During an adjustable time interval of from zero to five seconds, dampening medium flows from the dipping or fountain roller 9 over the intermediate roller 10, the dampening-medium distributor roller 11, the inking roller 1 and the intermediate roller 7 into the inking unit section of the combined dampening-inking unit. Simultaneously, some ink does travel also over the intermediate roller 7 from the inking unit section onto the first inking roller 1.

The predampening lasts until the inking unit train of the combined dampening-inking unit is saturated with dampening medium or dampening solution i.e. until ink and dampening medium have reached a state of equilibrium which also prevails throughout the printing production run. In this control stage, the first inking roller 1 is at its greatest distance from the surface of the plate cylinder 6. This distance corresponds to the width of the gap 36. The remaining inking rollers 2 to 5 have not varied the position thereof.

During this predampening of the inking unit section, the dipping roller 9 and the metering roller 10 rotate at increased speed, for example, at 200 rpm. After the predampening of the inking unit section has been terminated, the rotary speed of the dipping and metering rollers 9 and 10 is again reduced to 10 rpm.

Figure 4:
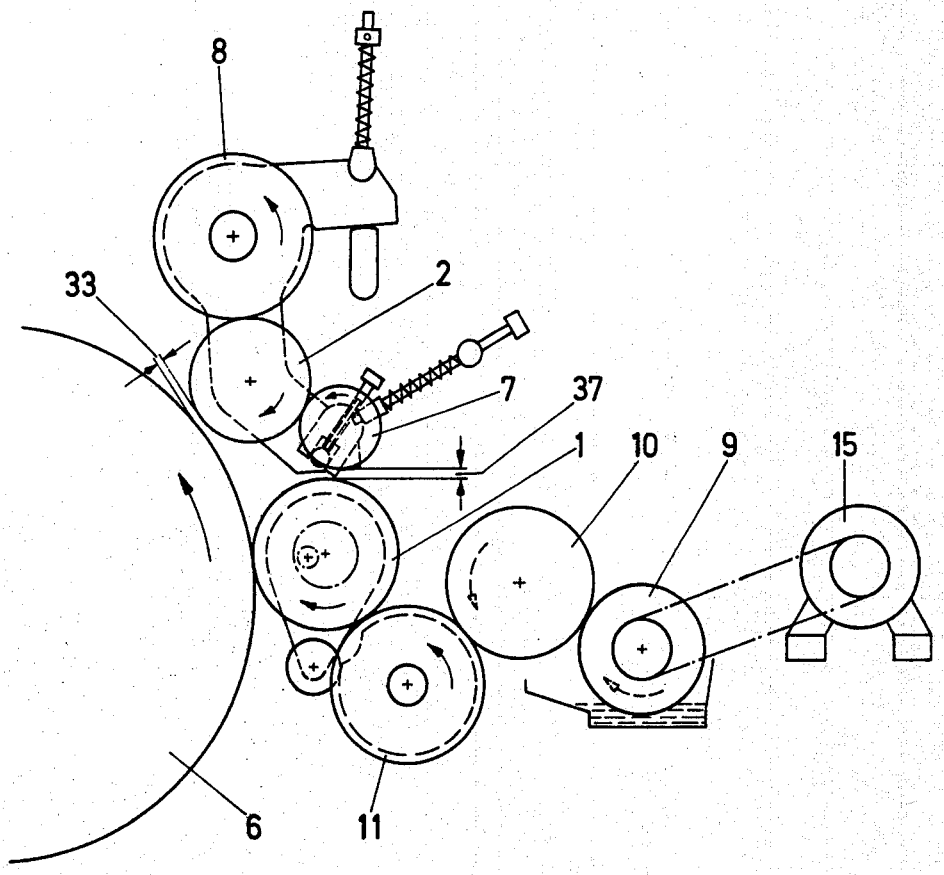
FIG. 4 is a further view of FIG. 2 showing the dampening-inking unit in a setting "Predampening Printing Plate"

Through the non-illustrated stage control, engagement of the inking roller 1 with the plate cylinder 6 is effected, as shown in FIG. 4. At the same time, the inking roller 1 separates from the intermediate roller 7 by a distance corresponding to the width of the gap 37. The inking roller 1 remains in contact with the dampening-medium distributor roller 11.

The dipping roller 9 and metering roller 10 rotating at low speed, for example, 10 rpm, supply the dampening-medium distributor roller 11 and, accordingly, the inking roller 1, also, with small amounts of dampening medium which are applied to the plate of the plate cylinder 6. In this control stage, the plate is thus predampening and, furthermore, already receives some ink.

Figure 5:
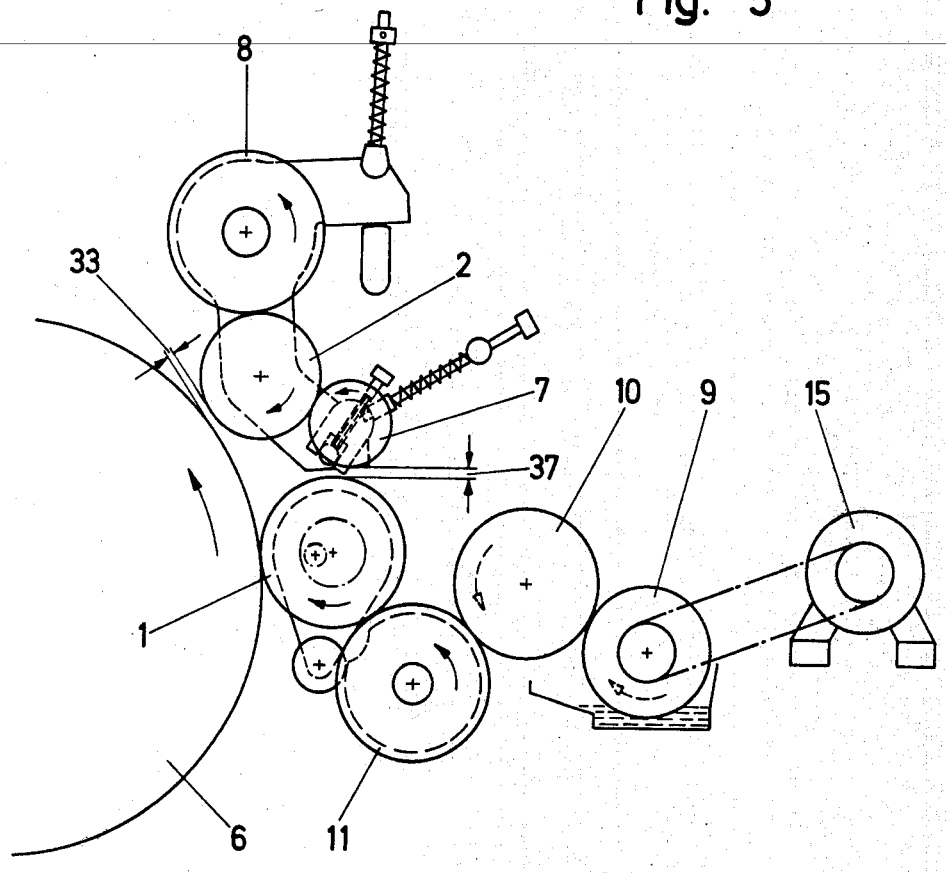
FIG. 5 is yet another view of FIG. 2 showing the dampening-inking unit in a setting "Superdampening the Printing Plate"

After predampening of the plate has ended, the button "Print" can be pressed. A further, non-illustrated stage control then ensures that the next control stages take place. First of all, as shown in FIG. 5, the positions or settings of all the rollers remains unchanged. Thus, only the inking roller 1 is engaged, whereas the remaining inking rollers 2 to 5 are still disengaged. The rotary speed of the dipping roller 9 and the metering roller 10 is again increased, for an adjustable time interval, for example, of from zero to five seconds, to 200 rpm, for example, so that a greater quantity of dampening medium is briefly supplied to the plate. This control stage is therefore called "superdampening the plate".

Figure 6:
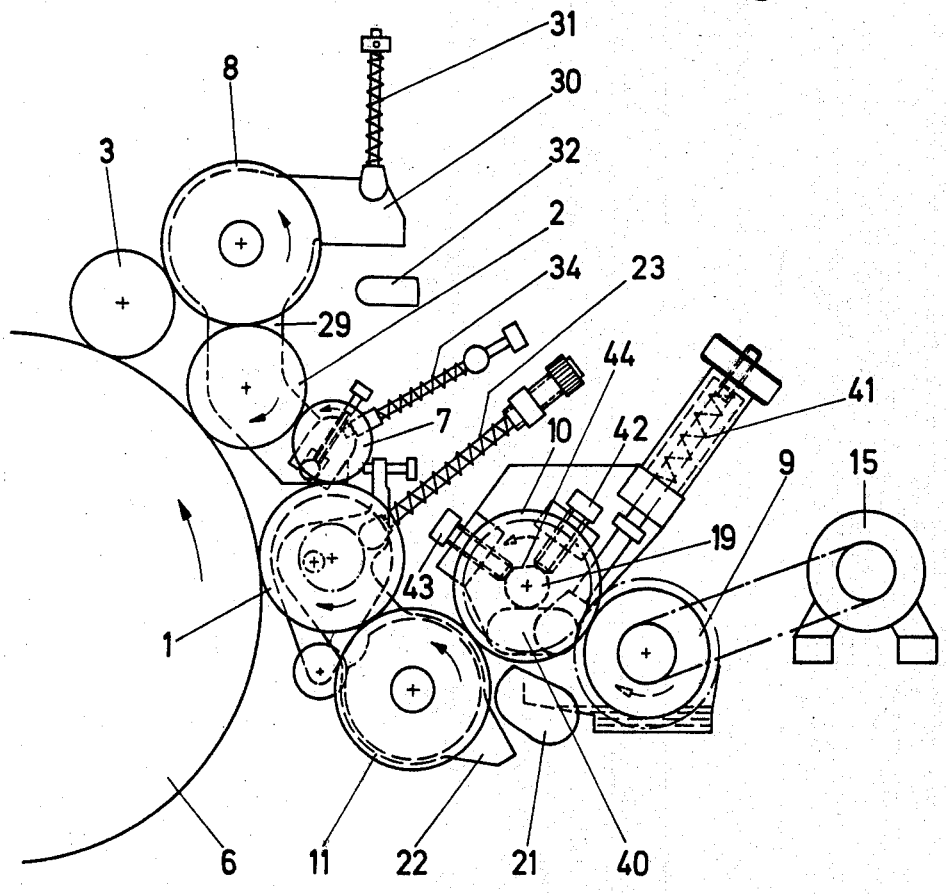
FIG. 6 is another view of FIG. 2 showing the dampening-inking unit in the setting of FIG. 1, namely "Production Run"

After the superdampening period, the rotational speed of the dipping and metering rollers 9 and 10 are again regulated down, and matched to the speed of the printing machine. The automatic stage control then serves for automatically controlling the rotary speed of the motor 15 as well as for bringing the remaining inking rollers 2 to 5 into engagement, as can be seen in FIG. 6. Since both the inking unit section of the combined dampening-inking unit as well as the plate have been transferred by predamping into such a condition as exists during the printing production run, no paper waste is produced during the paper travel which is synchronized with the bringing into engagement of the inking rollers. The offset printing unit is in full operational readiness. No change occurs in the distribution of the ink by the ink rollers.

The special disposition of the rollers, namely the engagement of the first inking roller 1 with the dampening-medium distributor roller 11 and the intermediate roller 3 has the effect that the first inking roller 1 applies dampening medium 12 predominantly, with a little ink, however, also, onto the plate while the next succeeding ink rollers 2 to 5, depending upon the distance thereof from the first inking roller 1, feed less dampening medium and, therefore, all the more ink, however, to the plate. The bridging intermediate roller 7 ensures that this relationship of the gradated or blended application of ink and dampening medium is maintained so that, as tests have shown, the ink is excellently laid out i.e.

effects a brilliant printing. If a determination is made that too large a portion of dampening medium is present in the employed dampening medium-ink emulsion as a result of non-illustrated measuring devices or an evaluation of the printed product, the rotary speed of the motor 15 and, consequently, of the dipping roller 9, as well as of the metering roller 10, is briefly regulated down to a minimal speed of, for example, 10 rpm. This downward regulation or control occurs automatically and ensures continuous maintenance of equilibrium between ink and dampening medium.

The special mounting of the metering roller 10 is presented in FIG. 6. As mentioned hereinbefore, the metering roller 10 can be shifted both in direction towards the dipping roller 9 as well as in direction towards the dampening-medium distributor roller 11. The shaft journals 19 of the metering roller 10 rest on swivelable and adjustable control levers or guide rods 40 which are biased by a spring 41 and effect engagement of the shaft journals 19, respectively, with two setscrews 42 and 43. These setscrews 42 and 43 are disposed approximately at an angle of 90° to one another. By actuating the setscrews 42, the gap and the compressive pressure, respectively, in the engagement or contact zone between the dampening-medium distributor roller 11 and the metering roller 10 are adjusted. An adjustment of the setscrew 43 changes the compressive force between the dipping roller 4 and the metering roller 10. The shaft journals 19 of the metering rollers 10 are provided with an adjustment face 44. By turning the shaft journal 19, the adjustment face 44 can be brought into contact with the setscrew 43. The metering roller 10 is thereby lifted away from the dipping roller 9 by means of the force of the compression spring 41. Adjustment of the desired or required film of dampening medium is very greatly facilitated by being able to inspect from above that part of the outer cylindrical surface of the metering roller 10 which follows the nip between the dipping roller 9 and metering roller 10.

Figure 7:
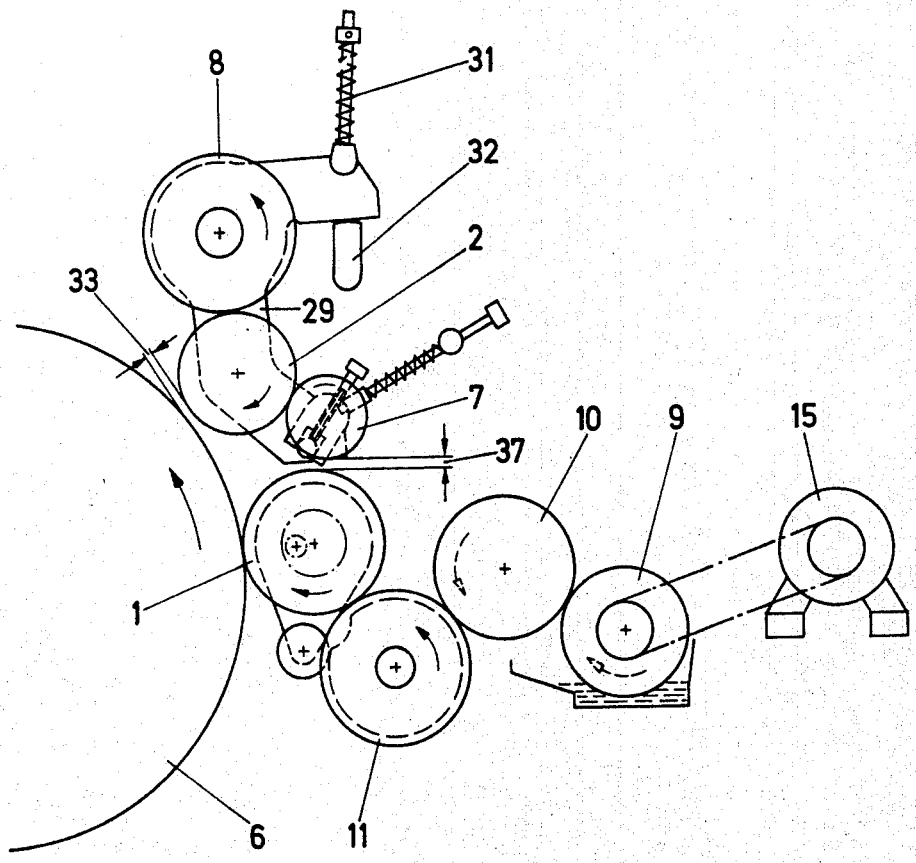
FIG. 7 is yet a further view of FIG. 2 showing the dampening-inking unit during a brief interruption in the printing operation.

If a brief printing stoppage should occur, for example, due to a skewed or double sheet, the stoppage cause being remediable, for example, within a time period of 30 seconds, the inking rollers 2, 3, 4 and 5 are automatically lifted away as shown in FIG. 7. In the interest of clarity and simplification, the inking rollers 3, 4 and 5 have been omitted from FIG. 7. With the swiveling of the bearing brackets 29, the intermediate roller 7 is also lifted away from the first inking roller 1. The feed of ink is accordingly interrupted. However, the first inking roller 1 remains in engagement with the plate cylinder 6. Since the rotational speed of the dipping roller 9 and the metering roller 10 has been regulated down to a minimal rotary speed of, for example, 10 rpm, however, by the disengagement of the hereinaforementioned inking rollers 2 to 5, dampening medium is supplied to the plate of the plate cylinder 6 in a small quantity over the dampening-medium distributor roller 11 and the first inking roller 1 during this brief interruption. Since the disengaged inking unit section continues to rotate, both sections of the combined dampening-inking unit thus remain in full operational readiness during this brief period. This also applies to the plate.

When the cause of the stoppage has been remedied within the set time interval, the printing production-run button can be pressed by the operator and the start-up of the printing machine set at the stage "Superdampening of the Printing Plate" i.e. the rotational speed of the dipping roller 9 and of the metering roller 10 is briefly raised again by increased drive from the motor 15 to approximately 200 rpm so that, initially, the plate is briefly superdampened, whereafter, as described hereinbefore, the rotational speed of the dipping and the metering rollers 9 and 10 is regulated down to the rotational speed of the printing machine, and the other inking rollers are set in synchronism with the paper travel, the intermediate roller 7 being again, naturally, brought into contact with the first inking roller.

Figure 8:
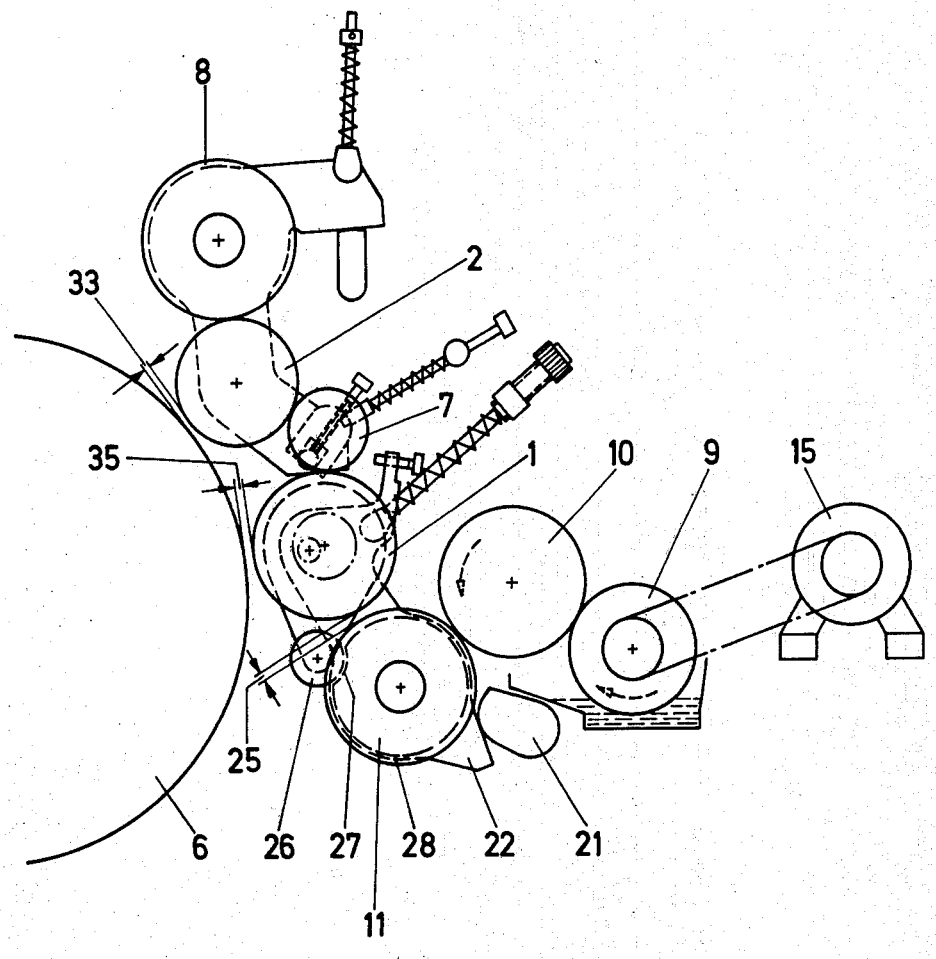
FIG. 8 is a view similar to that of FIG. 2 wherein all of the rollers of the combined dampening-inking unit are in the same position during a long interruption in the printing operation.

If a length interruption or stoppage of the offset printing machine is necessary, on the other hand, whether it be that tacky ink has transported a sheet up to the plate cylinder or that the blanket cylinders have to be washed, then, as shown in FIG. 8, the simultaneous automatic disengagement of all of the inking rollers 1 to 5 from the plate cylinder 6 is effected, the non-illustrated stage control swiveling the first inking roller 1 by means of the trip cam 21 and the control beak 22 so far that the roller 26 falls into the recess 27 formed in the control cam 28, as a result of which, because of the eccentric mounting thereof, the inking roller 1 is lifted off the dampening-liquid distributor roller 11 a distance corresponding to the width of the gap 25. In this control position or setting, the motor 15 drives the dipping roller 9 and the metering roller 10, yet only at a reduced speed of, for example, 10 r.p.m. It should be mentioned generally that, as long as the main switch of the printing machine is switched on i.e. power is supplied to all points of the machine, the dipping roller 9 and the metering roller 10 are always driven at minimal rotary speed even after the main motor has been shut down.

When the operator wishes to restart the printing machine at the end of the length interruption, he need only press the printing production-run button, and the hereinaforementioned stage controls ensure an automatic execution of the entire start-up operation i.e. initially, the dampening unit section, then the inking unit section and, thereafter, the plate are predampened and, finally, before the remaining inking rollers are brought into engagement, a brief superdampening of the plate is effected. Thus, both for a normal start-up after the printing machine has been shut down for a long period of time as well as after very short and very long interruptions in the printing production run, assurance is provided that, when paper travel has been initiated, the printing machine is fully ready for printing and operates virtually without any occurrence of waste.

Figure 9:
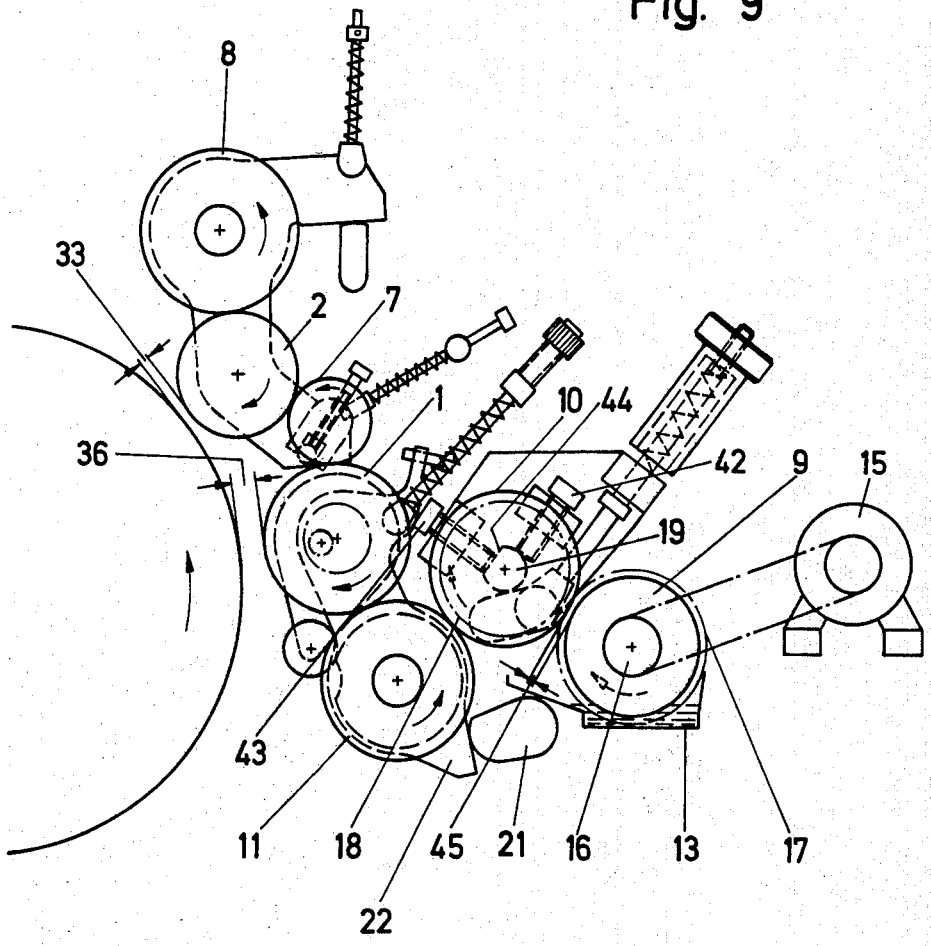
FIG. 9 is a view similar to that of FIG. 2 of the rollers of the combined dampening-inking unit in an adjusted position thereof during a washing process.

To wash the combined inking-dampening unit, adjustment to the control stage "Predampening the Ink Unit" should be made, as shown in FIG. 9. In addition, the shaft journals 19 of the metering roller 10 must be turned manually so that the adjustment face 44 is located opposite the setscrew 43, whereby the metering roller 10 is lifted off the dipping or fountain roller 9 a distance corresponding to the width of a gap 45. At the same time, the spur gear 17 fastened on the shaft journal 16 and the spur gear 18 mounted on the shaft journal 19 are also disengaged. The motor 15 then drives the dipping roller 9 at low speed such as 10 r.p.m., for example. On the other hand, the metering roller 10 is pressed with somewhat greater force against the dampening medium distributor roller 11 due to a special location of the setscrew 42. This special location of the setscrew 42 is that the axis of symmetry thereof does not coincide with the connecting line between the rotational axis of the metering roller 10 and the rotational axis of the dampening medium distributor roller 11, in the normal operating position of both, but rather, deviates slightly therefrom so that, when the metering roller 10 is disengaged from the dipping roller 9, greater pressure is produced in the engagement or contact zone between the metering roller 10 and the dampening medium distributor roller 11.

The roughness of the chromium surface of the dampening medium distributor roller 1 is adequate for driving both the metering roller 10 as well as the inking roller 1 with the intermediate roller 7 during the then starting washing operation. It should be mentioned that the start of the washing operation is possible only when a non-illustrated limit switch is actuated by the turning of the shaft journals 19 to the position thereof shown in FIG. 9. Since the film of dampening medium flowing back in direction toward the dampening medium tank or fountain 13 contains ink particles which reach the outer cylindrical surface of the oleophilic metering roller 10 and deposit there, despite the hydrophilic character of the surface of the dampening medium distributor roller 11, as has been revealed in tests, it is exceptionally advantageous to wash the metering roller 10 with all the other rollers except the dipping roller 9.

A significant advantage of the contrarotation of the dampening medium distributor roller 11 and the metering roller 10 in the engagement or contact zone thereof should be noted. In film dampening units, such as described in U.S. Pat. No. 3,433,155, for example, wherein the metering and dampening medium distributor rollers cooperatively turn in the same direction in the engagement or contact zone thereof, it is possible that a shut-off effect may occur in the contact zone if the contact or engagement pressure is too great. Insufficient dampening-medium guidance is a consequence thereof.

This is avoided by the contrarotation of the dampening-medium distributor roller 11 and the metering roller 10 in the contact zone thereof. If the contact pressure should be too great, no shut-off effect can ever occur since the dampening medium is forcibly removed. A dampening unit section according to the invention is therefore insensitive to adjustment errors of the rollers 10 and 11.

As mentioned hereinbefore, modifications of the aforedescribed embodiment of the invention are conceivable. Thus, for example, it is possible to vary the number of inking rollers depending upon requirements. Furthermore, the diameter of the intermediate roller may be made equal to or greater than that of the neighboring ink rollers. This permits a construction of the drive of the intermediate roller so as to obtain a large distribution stroke.

We claim:

1. Combined dampening-inking unit for offset printing units having an inking unit section and a dampening unit section, the inking unit section being disposed adjacent a rotary plate cylinder and including a first inking roller and at least a second inking roller, as viewed in rotational direction of the plate cylinder, the first and the second inking rollers being engageable with the plate cylinder, means for adjustably mounting the first inking roller and the second inking roller independently of one another, the dampening unit section including a dipping roller, a dampening-medium distributor roller and a metering roller cooperatively engageable with the dipping roller and the dampening-medium distributor roller for supplying dampening medium to the dampening-medium distributor roller, the dampening-medium distributor roller being engageable with the first inking roller for predampening the inking unit and the plate cylinder, comprising an oleophilic roller intermediate the first and the second inking rollers, means for adjusting said intermediate roller independently of the first inking roller simultaneously together with the second inking roller, first means for shifting the first inking roller into a first control position wherein the first inking roller is spaced away from both the plate cylinder and the dampening-medium distributor roller and is connected by said intermediate roller to the inking unit, second means for shifting the first inking roller into a second control position wherein the first inking roller engages said intermediate roller and is in engagement with the dampening-medium distributor roller for predampening the inking unit, and third means for shifting the first inking roller into a third control position for predampening the plate cylinder wherein the first inking roller engages the plate cylinder while maintaining engagement with the dampening-medium distributor roller and being out of contact with said intermediate roller.

2. Combined dampening-inking unit according to claim 1 including mounting means for axially moving said intermediate roller disposed between said first inking roller and said second inking roller.

3. Combined dampening-inking unit according to claim 2 wherein said intermediate roller has a diameter considerably smaller than that of said first and said second inking roller.

4. Combined dampening-inking unit for offset printing units according to claim 1 including means for driving the dipping roller at variable speed, the dipping roller having means cooperating with said driving means cooperating with said driving means for driving said metering roller, and including means for uncoupling the metering roller from said driving means of the dipping roller and for disengaging the metering roller from the dipping roller for washing the dampening-inking unit.

* * * * *